United States Patent [19]

Rourke

[11] 4,184,647

[45] Jan. 22, 1980

[54] ELECTRICAL CABLE UNWINDER

[76] Inventor: Arthur G. Rourke, 3 Robin La. (Trailer Park), Bayshore, N.Y. 11706

[21] Appl. No.: 766,140

[22] Filed: Feb. 7, 1977

[51] Int. Cl.[2] ..... B65H 75/00; B65H 49/00

[52] U.S. Cl. ..... 242/54 R; 242/129.8

[58] Field of Search ..... 242/54 R, 129.8, 128, 242/129, 78.6; 248/188.2; 280/763, 766

[56] References Cited

U.S. PATENT DOCUMENTS

| | | | |
|---|---|---|---|
| 1,873,422 | 8/1932 | Keller | 242/128 |
| 3,125,310 | 3/1964 | Margulis | 242/129 |
| 3,323,752 | 6/1967 | Kurtz | 242/129.8 |
| 3,464,647 | 9/1969 | Jacobi | 242/129 |
| 3,498,564 | 3/1970 | Dismon | 242/128 |
| 3,721,394 | 3/1973 | Reiser | 242/54 R |
| 3,841,631 | 10/1974 | Dolan | 248/188.2 |

*Primary Examiner*—Edward J. McCarthy
*Attorney, Agent, or Firm*—Peter Kent

[57] ABSTRACT

A portable electrical cable unwinder comprising a wheeled base with brakes, a rotatable disc upon a thrust bearing, friction supporting retarders, a core frame, and a lid.

11 Claims, 6 Drawing Figures

Fig. 1
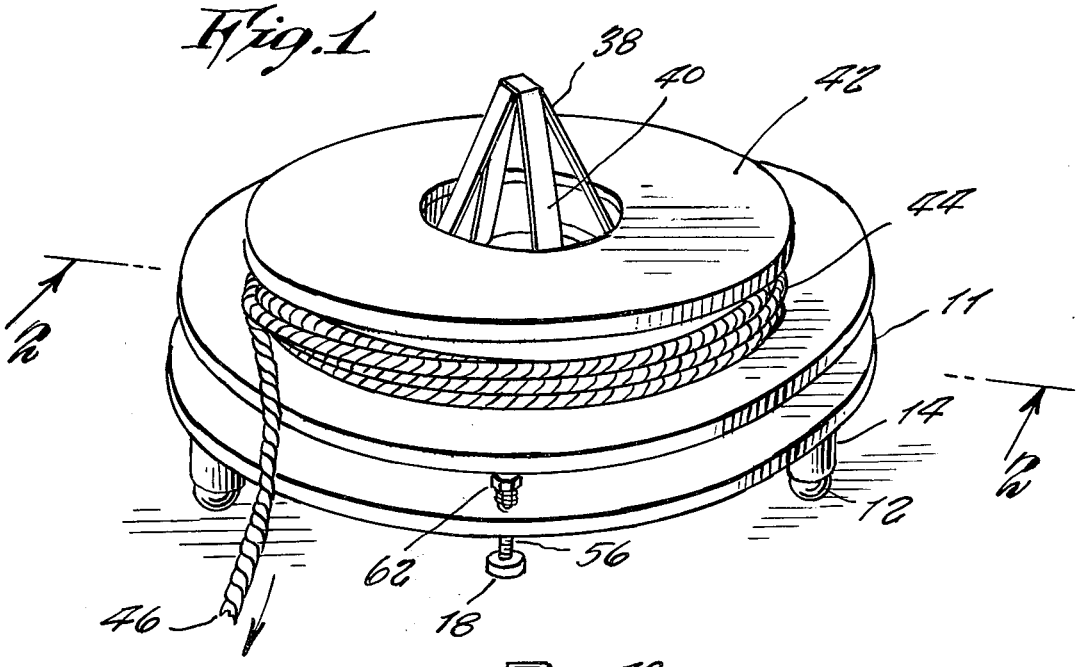
Fig. 2
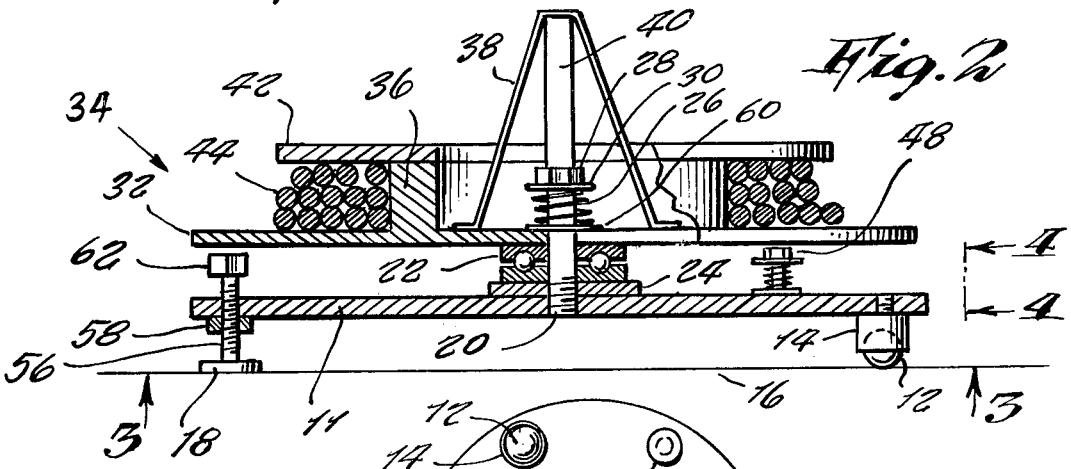
Fig. 3
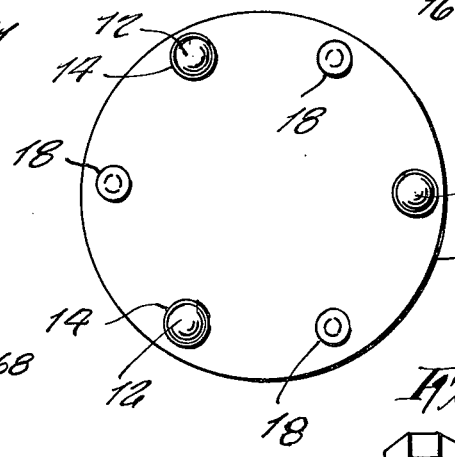
Fig. 4
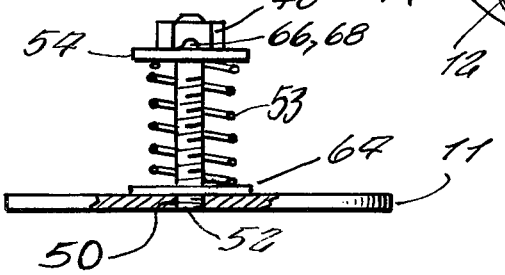
Fig. 5
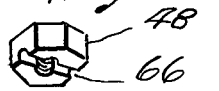
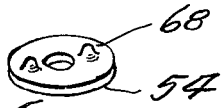
Fig. 6

ELECTRICAL CABLE UNWINDER

BACKGROUND OF THE INVENTION

1. Field of the Invention

This invention relates to unwinding equipment and, in particular, to unwinding miscellaneous coils of bulky material.

2. Prior Art

Unwinding equipment is at least several hundred years old as used for yarn. Unwinding of metal wire coils has been done for over a century.

Broadly speaking, unwinding is done about either a horizontal or vertical axis. All unwinding equipment requires retarding action for adequate control. Wheel mounted portable unwinders have been disclosed by Bost in U.S. Pat. No. 3,902,679, Sawyer, et al., in U.S. Pat. No. 3,491,967, and Bennett in U.S. Pat. No. 3,831,877.

Few of the patents examined during search disclosed thrust bearings to provide for reduced turning effort and tension upon the pulled material and apparently none included adjustable braking.

SUMMARY OF THE INVENTION

It is therefore an object of this invention to overcome the limitations and disadvantages in the unwinding devices in the prior art and currently available in the market.

One of the objects of the invention is to provide an unwinding device embodying improved advanced principles of design and construction.

An important object of the invention is to provide an unwinding device which is comprised of a number of simple durable parts and components which can be economically manufactured and readily assembled.

A signficant object of the invention is to provide an unwinding device, so designed and constructed that it can be readily assembled to almost any typical reel now in use.

Another object of the invention is to provide an unwinding device that is readily portable, i.e., on wheels.

A further object of the invention is to provide an unwinding device requiring less pulling effort.

Yet another object of the invention is to provide an unwinding device with some control of payout rate.

A still further object of the invention is to provide an unwinding device for handling loose coils or reels interchangeably.

A portable electrical cable unwinder comprises, according to the principles of this invention, a swivel wheeled base provided with adjustable brakes, and supporting a thrust bearing about a central stud upon and about which a rotatable disc rests which is preferably provided with a core frame and a lid and is supported from the base by adjustable friction retarders.

Further objects and advantages of this invention will appear more clearly from the following description of a non-limiting illustrative embodiment and the accompanying drawings in which like numerals designate like parts throughout the several views.

DESCRIPTION OF THE DRAWINGS

Briefly summarized, a preferred embodiment of the invention is described in conjunction with an illustrative disclosure thereof in the accompanying drawings, in which:

FIG. 1 is a pictorial representation of the electrical cable unwinder;

FIG. 2 is an elevation view in partial section showing various features according to the principles of this invention;

FIG. 3 is a bottom view of the base;

FIG. 4 is a detailed view of the friction support device;

FIG. 5 is a pictorial view of a special nut; and

FIG. 6 is a pictorial view of a special washer.

DESCRIPTION OF THE TYPICAL EMBODIMENT

In the drawings a portable unwinder for electrical cable 44 embodying features of the invention is illustrated comprising a base 11 to which are assembled three rotatable anti-friction swivel casters 14 having wheels 12, adjustable brakes having feet 18 which may have soft pads such as rubber or plastic. The brakes are simple and include a bolt 56 threaded into a hole in the base 11 and locked by a nut 58 which may be above or below the base 11, the bolt 56 provided with a head 62 or other wrenching protuberances.

A stud 20 is threaded into the base 11 in a central location and preferably locked thereto. A thrust bearing 22 is located about the stud 20 and rests, if desired, upon the base 11 or upon a spacer 24 which may be used to distribute the load and which may be threaded to act as a locknut for stud 20. Spring 26 is placed upon stud 20 between upper 30 and lower 60 washers, and nut 28 is employed to hold down rotatable disc 32 or reel 34 comprised of disc 32 with an annular extension 36 and lid 42.

Coiled material 44 is placed upon disc 32 about core frame 38, 40 or is contained within reel 34, which may be placed on top of the disc 32 or directly upon bearing 22. Adjustable friction supports 48 may be provided to retard the payout motion rate of freely revolving disc 32 when the loose end 46 of the coiled material is pulled. Stud 52 is threaded into hole 50 in base 11 and spring 53 is placed about the stud 52 between upper 54 and lower 64 washers to exert locking pressure upon nut 48 which may be grooved 66 to engage with protrusions 68 upon upper washer 54. Nut 48 presses against and supports disc 32 both to balance the disc and keep it from wobbling as well as to provide a frictional drag to keep the disc from running away due to the pulling effort upon end 46 and the inertia of the rotating mass of coiled material 44, disc 32, and lid 42.

When using a loose coil 44 thrown over frame 38, 40 the lid 42 may be put on top to help keep the coil 44 in place.

The unwinder may be readily moved about on at least three wheels or casters on the ground or floor 16. Several adjustable brakes are preferred to keep the unwinder in position—the brakes adjusted to lift the wheels 12 off the floor 16. The thrust bearing permits the unwinder disc or reel to be turned with minimum effort by pulling loose end 46.

Locking devices such as the springs, the grooved nuts and bumpy washers, or other known lockable threaded fasteners are desirable to reduce required attention when in use.

The unwinder may be manufactured by known methods of known materials including wood products, metals, and plastics and assembled with standard fasteners, bearing and caster compoments—thus constituting an economical device.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. A portable unwinder for electrical cable and the like comprising in combination:

a base;

a stud centrally located upon and extending upwards from the base;

a thrust bearing about the stud and resting upon the base;

a rotatable disc resting upon the thrust bearing and approximately centered relative to the stud; and means assembled to and projecting upwards from the base for supporting and retarding the rotation of the disc, the combination permitting rotation of the disc relative to the base and usable as an unwinder by placing coiled material upon the disc and pulling a loose end of the material, whereupon the disc and the coil upon it rotate in response to the pulling force.

2. An unwinder as in claim 1 wherein the rotatable disc comprises a reel having a core.

3. An unwinder as in claim 1 wherein the centrally located stud is threaded and projects upwards through an opening in the disc, the stud having a washer, a coil spring and a threaded nut thereabout, the spring bearing against the nut and urging the washer against the disc so that the disc is retained against the thrust bearing.

4. An unwinder as in claim 1 further comprising friction support means assembled to and projecting upwards from the base and supporting and retarding the rotation of the disc.

5. An unwinder as in claim 1 wherein the means comprises a threaded stud and a threaded nut capable of engaging the threads on the stud.

6. A portable unwinder for electrical cable and the like comprising in combination:

a base;

a stud centrally located upon and extending upwards from the base;

a thrust bearing about the stud and resting upon the base;

a rotatable disc resting upon the thrust bearing and approximately centered relative to the stud; and a core frame attached to the rotating disc and projecting upwards therefrom for centering a coil of material when placed upon the disc, the combination permitting rotation of the disc relative to the base and usable as an unwinder by pulling a loose end of the material, whereupon the disc and the coil upon it rotate in response to the pulling force.

7. An unwinder as in claim 6 further comprising a lid which may be placed on top of any coil of material on the disc.

8. An unwinder as in claim 1 wherein the base has at least three rotatable anti-friction members upon which the base rests and may move, and at least one brake descending from the base and adjustable so as to restrict base motion.

9. An unwinder as in claim 8 wherein the brake comprises a threaded bolt threadably engaged with the base and descending therefrom, a locknut upon the bolt to lock it against rotation relative to the base, bolt wrench engaging means, and a large foot at the lower end of the bolt, the foot for engaging the floor upon which the base has been placed in order to keep the base from moving.

10. An unwinder as in claim 9 wherein the rotatable anti-friction members are swivel casters.

11. An unwinder as in claim 6 wherein the centrally located stud is threaded and projects upwards through an opening in the disc, the stud having a washer, a coil spring and a threaded nut thereabout, the spring bearing against the nut and urging the washer against the disc so that the disc is retained against the thrust bearing.

* * * * *